US011832064B2

(12) United States Patent
Kuipers et al.

(10) Patent No.: US 11,832,064 B2
(45) Date of Patent: Nov. 28, 2023

(54) HEARING DEVICE COMPRISING A SLIDABLE MEMBER

(71) Applicant: SONOVA AG, Staefa (CH)

(72) Inventors: Erwin Kuipers, Wolfhausen (CH); Manuel Weibel, Erlenbach (CH)

(73) Assignee: Sonova AG, Staefa (CH)

( * ) Notice: Subject to any disclaimer, the term of this patent is extended or adjusted under 35 U.S.C. 154(b) by 115 days.

(21) Appl. No.: 17/669,660

(22) Filed: Feb. 11, 2022

(65) Prior Publication Data

US 2022/0295199 A1 Sep. 15, 2022

(30) Foreign Application Priority Data

Mar. 12, 2021 (EP) ..... 21162440

(51) Int. Cl.
*H04R 25/00* (2006.01)

(52) U.S. Cl.
CPC ..... *H04R 25/603* (2019.05); *H04R 25/602* (2013.01); *H04R 25/65* (2013.01); *H04R 2225/025* (2013.01); *H04R 2225/31* (2013.01); *H04R 2460/11* (2013.01)

(58) Field of Classification Search
CPC .... H04R 25/603; H04R 25/602; H04R 25/65; H04R 2225/025; H04R 2225/31; H04R 2460/11
USPC ..... 381/312, 322, 324
See application file for complete search history.

(56) References Cited

U.S. PATENT DOCUMENTS

| | | | |
|---|---|---|---|
| 3,627,848 | A | 12/1971 | Bishop |
| 3,668,118 | A | 6/1972 | Rhodes |
| 2019/0208343 | A1 | 7/2019 | Monti et al. |

FOREIGN PATENT DOCUMENTS

| | | | |
|---|---|---|---|
| EP | 3310074 | A1 | 4/2018 |
| EP | 3471432 | | 4/2019 |
| EP | 3627848 | | 3/2020 |
| EP | 3675524 | | 7/2020 |
| WO | 2019052714 | A1 | 3/2019 |
| WO | 2019056715 | A1 | 3/2019 |

OTHER PUBLICATIONS

"Extended European Search Report received in EP Application No. 21162440.8-1207 dated Aug. 27, 2021".

*Primary Examiner* — George C Monikang
(74) *Attorney, Agent, or Firm* — ALG Intellectual Property, LLC

(57) ABSTRACT

The disclosure relates to a hearing device comprising a housing configured to be at least partially inserted into an ear canal of a user, the housing having an opening leading to an interior space enclosed by the housing; a slidable member moveable relative to the opening between different positions including a first position and a second position; an actuator configured to actuate the movement of the slidable member forth from the first position to the second position, and back from the second position to the first position; and a controller configured to control the actuator. The disclosure further relates to a hearing system comprising the hearing device and a stationary device, and a method of operating the hearing device.

15 Claims, 7 Drawing Sheets

HEARING DEVICE COMPRISING A SLIDABLE MEMBER

RELATED APPLICATIONS

The present application claims priority to EP Patent Application No. EP21162440, filed Mar. 12, 2021, the contents of which are hereby incorporated by reference in their entirety.

BACKGROUND INFORMATION

Hearing devices may be used to improve the hearing capability or communication capability of a user, for instance by compensating a hearing loss of a hearing-impaired user, in which case the hearing device is commonly referred to as a hearing instrument such as a hearing aid, or hearing prosthesis. A hearing device may also be used to output sound based on an audio signal which may be communicated by a wire or wirelessly to the hearing device. A hearing device may also be used to reproduce a sound in a user's ear canal detected by a microphone. The reproduced sound may be amplified to account for a hearing loss, such as in a hearing instrument, or may be output without accounting for a hearing loss, for instance to provide for a faithful reproduction of detected ambient sound and/or to add sound features of an augmented reality in the reproduced ambient sound, such as in a hearable. A hearing device may also provide for a situational enhancement of an acoustic scene, e.g. beamforming and/or active noise cancelling (ANC), with or without amplification of the reproduced sound. A hearing device may also be implemented as a hearing protection device, such as an earplug, configured to protect the user's hearing. A hearing system comprising two hearing devices configured to be worn at different ears of the user is often referred to as a binaural hearing device.

Some types of hearing devices comprise a housing configured to be at least partially inserted into an ear canal of a user, for instance a housing of an earpiece. Examples include earbuds, earphones, hearables, earplugs, and hearing instruments such as receiver-in-the-canal (RIC) hearing aids, behind-the-ear (BTE) hearing aids, in-the-ear (ITE) hearing aids, invisible-in-the-canal (IIC) hearing aids, and completely-in-the-canal (CIC) hearing aids. Sensitive components required for an operation of the hearing device are typically accommodated in the interior space enclosed by the housing. Those components can include, for instance, an output transducer for generating sound waves, a processor to perform a signal processing of an audio signal, a microphone to detect a sound to be reproduced by the hearing device, a biometric sensor to detect a biometric property of the user, another sensor to detect a property in the ear canal and/or the ambient environment of the user, and/or the like. Some of those components require an opening at the housing for their proper functioning. For instance, such an opening may be provided as a sound outlet required to output the sound generated by the output transducer into the ear canal and/or an opening required for a sensor to detect a property external from the housing. An opening in the housing may also be required to provide desired acoustic characteristics and/or usage comfort for the user. For instance, the hearing device may be provided with a venting channel extending through the housing between a first opening and a second opening at the housing to provide for a venting of sound waves between an inner region of the ear canal and an ambient environment outside the ear canal.

Such an opening at the housing can act as a port for contaminants entering the interior space of the housing and constituting a potential danger for the components contained therein. The contaminants may comprise various types of ingress, in particular substances excreted from the user's skin such as cerumen and/or substances prevailing in the ambient environment such as dirt. For instance, contaminants such as particles, bacteria, germs, dust, dirt, cerumen may enter the interior space and may settle down on a surface exposed to the interior space. A certain protection from the contaminants entering the interior space may be achieved by a protective equipment provided at the opening, for instance a cerumen filter. But even such protective equipment may inherently require an opening to still provide for the intended functionality of the hearing device, such that the ingress can be reduced by the protective equipment only to a certain extent. Therefore, it would be desirable to allow a removal of the contaminants which have entered the housing through the opening in a convenient way.

Removing the contaminants from the interior space of the housing may be repeatedly performed manually after certain time intervals of using the hearing device. A manual cleaning can, however, be cumbersome due to a small size of the housing, and may also be forgotten or postponed by the user until irreversible harm has been caused to the components. It would therefore be desirable to integrate such a cleaning procedure in a regular routine of usage of the hearing device, wherein an effort required by the user is kept as low as possible and/or a time in which the user is kept away from regularly using the hearing device is kept as short as possible.

A hearing device may comprise an active vent including a venting channel and a valve member that can be moved between different positions in the venting channel in order to adjust an effective size of the venting channel. Such a hearing device is disclosed in international patent application publication No. WO 2019/052714 A1.

BRIEF DESCRIPTION OF THE DRAWINGS

Reference will now be made in detail to embodiments, examples of which are illustrated in the accompanying drawings. The drawings illustrate various embodiments and are a part of the specification. The illustrated embodiments are merely examples and do not limit the scope of the disclosure. Throughout the drawings, identical or similar reference numbers designate identical or similar elements. In the drawings.

DETAILED DESCRIPTION

Figure 1:
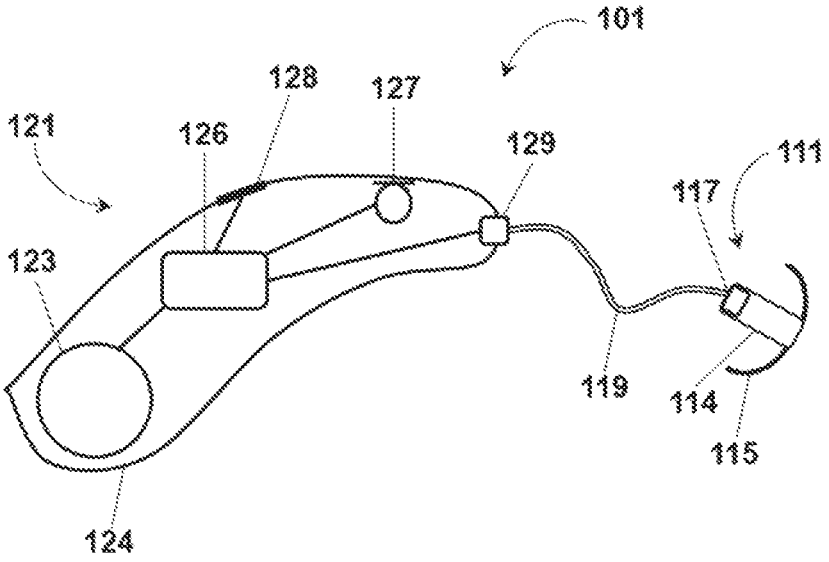
FIG. 1 schematically illustrates an exemplary hearing device comprising an earpiece configured to be at least partially inserted into an ear canal of a user.

The disclosure relates to a hearing device comprising a housing configured to be at least partially inserted into an ear canal of a user, the housing having an opening leading to an interior space enclosed by the housing, a slidable member moveable relative to the opening and/or relative to a component contained in the interior space, an actuator configured to actuate the movement of the slidable member, and a controller configured to control the actuator. The disclosure further relates to a hearing system comprising the hearing device and a stationary device configured to be operated at a fixed location remote from the user, and a method of operating a hearing device.

It is a feature of the present disclosure to avoid at least one of the above mentioned disadvantages and to provide a hearing device with the ability to reduce a potential negative impact of contaminants on a desired functionality of the hearing device. It is a further feature to provide a hearing device equipped for an automatic removal and/or a facilitated manual removal of contaminants from the opening and/or from the interior space inside the housing. It is another feature to implement such a cleaning functionality of the hearing device in a way minimizing a negative impact on a regular usage of the hearing device and/or optimizing a handling of the cleaning functionality for the user. It is a further feature to provide corresponding advantages in a hearing system including the hearing device and a stationary device, and/or in a method of operating the hearing device. It is yet another feature to implement these advantages in a hearing device by further minimizing associated constructional efforts and/or costs and/or space consumption in the hearing device.

At least one of these features can be achieved by the hearing devices, hearing systems, and methods described herein.

Accordingly, the present disclosure proposes a hearing device comprising a housing configured to be at least partially inserted into an ear canal of a user, the housing having an opening leading to an interior space enclosed by the housing; a slidable member moveable relative to the opening between different positions including a first position and a second position; an actuator configured to actuate the movement of the slidable member forth from the first position to the second position, and back from the second position to the first position; and a controller configured to control the actuator, wherein the controller is configured to control the actuator to actuate the slidable member to repetitively move forth and back between the first and second position at a predetermined repetition rate.

In this way, contaminants at the opening and/or contaminants entering the interior space of the housing can be transported relative to the opening and/or relative to the component contained in the interior space by the movement of the slidable member. In particular, the repetitive movement of the slidable member can allow a detaching of contaminants which have nested or incrusted at the opening and/or in the interior space. For instance, the contaminants may be transported away from the opening in order to avoid clogging of the opening, or away from the component, for instance toward the opening, in order to avoid a damage of the component caused by the contaminants. A potential negative impact of contaminants on a desired functionality of the hearing device can thus be reduced. Further, the contaminants can thus be accumulated at a dedicated volume portion of the interior space by the repetitive movement of the slidable member, for instance close to the opening or close to another opening, allowing a facilitated manual removal of the contaminants from the interior space and/or the contaminants can be transported out of the interior space through the opening or through another opening by the repetitive movement of the slidable member, allowing an automatic removal of the contaminations from the interior space.

Independently, the present disclosure proposes a hearing system comprising the hearing device and a stationary device configured to be operated at a fixed location remote from the user, wherein the hearing device can be mounted to the stationary device.

Independently, the present disclosure proposes a method of operating a hearing device, the hearing device comprising a housing configured to be at least partially inserted into an ear canal of a user, the housing having an opening leading to an interior space enclosed by the housing; a slidable member moveable relative to the opening between different positions including a first position and a second position; and an actuator configured to actuate the movement of the slidable member forth from the first position to the second position, and back from the second position to the first position, wherein the method comprises controlling the actuator to actuate the slidable member to repetitively move forth and back between the first and second position at a predetermined repetition rate.

Independently, the present disclosure proposes a non-transitory computer-readable medium storing instructions that, when executed by a processing unit included in the hearing device and/or stationary device, cause the processing unit to perform said method. For instance, the processing unit may be implemented as the controller comprised in the hearing device and/or a controller comprised in the stationary device.

Subsequently, additional features of some implementations of the hearing device and/or the hearing system and/or the method of operating a hearing device and/or the computer-readable medium are described. Each of those features can be provided solely or in combination with at least another feature. The features can be correspondingly provided in some implementations of the hearing device and/or the hearing system and/or the method and/or the computer-readable medium.

In some implementations, the slidable member is moveable relative to a component in contained in the interior space. For instance, the component may be an output transducer configured to generate sound waves and/or a processor and/or a sensor and/or a component of an electric circuit. Contaminants potentially affecting a proper functioning of the components may thus be removed and/or moved away from the components.

In some implementations, the controller is configured to gather information indicative of whether the housing is removed from the ear canal, and to control the actuator to actuate said repetitive movement of the slidable member when the housing is removed from the ear canal. In this way, an undesired actuation of the repetitive movement of the slidable member when the housing is worn at least partially inside the ear canal can be avoided.

In some implementations, the controller is configured to gather information whether the hearing device is mounted to a stationary device configured to be operated at a fixed location remote from the user, and to control the actuator to actuate the repetitive movement of the slidable member when the hearing device is mounted to the stationary device. This can allow, on the one hand, to determine that the housing is removed from the ear canal, and, on the other hand, to schedule the actuation of the repetitive movement of the slidable member at a time that is convenient for the user, in particular at time in which the user does not intend to wear the hearing device. In some instances, the information whether the hearing device is mounted to a stationary device comprises information whether the hearing device is disposed in the stationary device. In some instances, the controller of the hearing device is configured to gather information about a connection with a controller of the stationary device, and to control the actuator to actuate the repetitive movement of the slidable member when the hearing device is mounted to the stationary device. In some instances, the hearing device comprises a rechargeable battery, and the stationary device comprises a charging station for the rechargeable battery.

In some implementations, the hearing device comprises a rechargeable battery, and the controller is configured to gather information about a charging status of the battery and to control the actuator to actuate the repetitive movement of the slidable member depending on the charging status. Thus, it can be ensured that enough power for actuating the repetitive movement of the slidable member is available and/or other functionalities of the hearing device or hearing system are not compromised. In particular, the controller can be configured to control the actuator to execute the repetitive switching when the charging status exceeds a threshold value, for instance when the battery is fully charged.

In some implementations, the opening leads to a venting channel configured to provide for a venting of sound waves between an inner region of the ear canal and an ambient environment outside the ear canal when the housing is at least partially inserted into the ear canal, wherein the slidable member is moveable relative to the venting channel such that an effective size of the venting channel can be adjusted by the movement of the slidable member forth or back between the first and second position. In some instances, the controller is configured to control the actuator to actuate, in a first operational mode, the movement of the slidable member forth or back between the first and second position to adjust the effective size of the venting channel, and, in a second operational mode, to actuate said repetitive movement of the slidable member. In this way, the slidable member may be employed for various functionalities of the hearing device. Associated constructional efforts and/or costs and/or a space consumption in the hearing device for providing those functionalities can thus be reduced.

In some implementations, the actuator is configured to provide a first actuation force for actuating the movement of the slidable member forth from the first position to the second position, and a second actuation force for actuating the movement of the slidable member back from the second position to the first position. In the first operational mode, the controller may be configured to control the actuator to provide the first actuation force for actuating the movement of the slidable member forth from the first position to the second position, or the second actuation force for actuating the movement of the slidable member back from the second position to the first position, to adjust the effective size of the venting channel. In the second operational mode, the controller may be configured to control the actuator to switch between providing the first actuation force and providing the second actuation force at the predetermined repetition rate such that the movement of the slidable member back and forth between the first position and the second position can be repetitively provided at the repetition rate. In some implementations, the controller is configured to control the actuator to provide the first actuation force for actuating the movement of the slidable member forth from the first position to the second position, and the second actuation force for actuating the movement of the slidable member back from the second position to the first position with an increased magnitude during the second operational mode as compared to a magnitude of the first and/or second actuation force provided during the first operational mode. In this way, be increasing the magnitude of the activation force during the repetitive movement of the slidable member, a desired removal of the contaminants can be rendered more effective.

In some implementations, the interior space is at least partially delimited by a venting channel extending between a first opening leading to an inner region of the ear canal, and a second opening leading to the ambient environment outside the ear canal or an outer region of the ear canal acoustically connected to the ambient environment, wherein the slidable member is provided in the venting channel. In some implementations, the interior space is at least partially delimited by a sound conduit extending between an output transducer contained in the interior space and the opening, wherein the slidable member is provided in the sound conduit. In some implementations, the interior space is at least partially delimited by a volume portion extending between an interface of a sensor contained in the interior space and the opening, wherein the slidable member is provided in said volume portion.

In some implementations, the hearing device comprises an output transducer configured to generate sound waves. In some instances, the output transducer is contained in the interior space. The opening may be a sound outlet for the sound waves generated by the output transducer. In particular the sound waves may be emitted into the ear canal through the opening when the housing is at least partially inserted into the ear canal. In some instances, the housing comprises a spout at which the opening is provided. In some instances, the slidable member has a cross section corresponding to the cross section of a volume portion enclosed by the spout. The movement of the slidable member may then extend into the spout.

In some implementations, a trajectory of the movement of the slidable member between the first position and the second position extends at least partially across the opening. In this way, contaminations may be effectively removed from the opening. In some implementations, during the movement of the slidable member between the first position and the second position, the slidable member is slidable along a surface exposed to the interior space. In this way, contaminations may be effectively removed from the surface exposed to the interior space. In particular, the surface may be a surface of the housing and/or a surface of a component contained in the interior space and/or a surface of a support of the slidable member along which the slidable member can be slidably moved. For instance, contaminants settling down at the opening and/or at the surface may thus be scraped off by the repetitive forth and back movement of the slidable member. The surface along which the slidable member can be moved may be provided in a longitudinal direction of the housing, in particular a direction in which the housing can be inserted into the ear canal, and/or in a circumferential direction of the housing, which may correspond to a circumferential direction of the ear canal wall when the housing is at least partially inserted into the ear canal.

In some implementations, the slidable member comprises a surface facing the opening, wherein the slidable member is moveable in a direction in which said surface faces the opening. In some implementations, the slidable member comprises a surface facing in a transverse direction relative to the opening, wherein the slidable member is moveable in said transverse direction. The surface of the slidable member can thus be appropriately provided depending on a moving direction of the slidable member relative to a position of the opening in order to allow a transport of the contaminants toward the opening.

In some implementations, the slidable member is spaced from the opening in the first position and in the second position of the slidable member. In particular, the spacing to the opening may be larger in the first position of the slidable member and smaller in the second position of the slidable member. A volume portion of the interior space leading to the opening may thus be provided extending within said spacing between the slidable member in the second position of the slidable member and the opening. Contaminants may then be transported by the slidable member to the volume portion leading to the opening and can be accumulated inside the volume portion. Accumulating the contaminants inside the volume portion leading to the opening can allow an easy removal of the contaminants at the opening. In the mean time, a proper functionality of the hearing device can be ensured by keeping the contaminants in the volume portion away from sensitive components.

In some implementations, the hearing device comprises a cerumen filter provided at the opening. The cerumen filter may prevent contaminants from entering the interior space to a certain extent. In some instances, said spacing from the opening of the slidable member in the first position and in the second position of the slidable member is provided with the cerumen filter provided at the opening. The volume portion of the interior space leading to the opening to which contaminants can be transported by the slidable member can thus be provided at the cerumen filter. The accumulated contaminants can then be removed from the volume portion after removing the cerumen filter from the opening.

In some implementations, the controller is configured to control the actuator to actuate the slidable member to repetitively move forth and back between the first and second position for a predetermined time. In some instances, the predetermined time is at least 10 seconds. In some instances, the predetermined time is at least 60 seconds. The longer the predetermined time, the more exhaustive the removal of the contaminants may be.

In some implementations, the repetition rate at which the slidable member is actuated to repetitively move forth and back is controlled to be constant by the controller, at least for a predetermined time interval. In some instances, the repetition rate may have a value between 1 Hz, corresponding to one forth and back movement of the slidable member per second, and 200 Hz, corresponding to two hundred forth and back movements of the slidable member per second. The larger the repetition rate, the more efficient a removal of contaminants settled down on a surface may be. In some instances, the repetition rate may have a value of at least 10 Hz. In some instances, the repetition rate may have a value of at least 50 Hz.

In some implementations, the repetition rate at which the slidable member is actuated to repetitively move forth and back is controlled to be varied by the controller. In some instances, the repetition rate may have a first constant value during a first predetermined time interval, and a second constant value during a second predetermined time interval subsequent to the first time interval. In some instances, during the first time interval, the repetition rate may be larger, and during the second time interval the repetition rate may be smaller. Varying the repetition rate may further contribute to an efficiency of the removal of the contaminants. In particular, a larger repetition rate may be more efficient to detach contaminants encrusted on a surface. A smaller repetition rate may be more efficient to transport rather loose contaminants to a desired position in the interior space, for instance close to the opening. For instance, the repetition rate may be at least 50 Hz in the first time interval, and at most 20 Hz in the second time interval. For instance, the first time interval may be at least 10 seconds, and the second time interval may be at least 5 seconds.

In some implementations, the slidable member comprises a surface formed of a hydrophobic and/or oleophobic material. In particular, the slidable member may be formed of the hydrophobic and/or oleophobic material and/or may comprise a coating of the hydrophobic and/or oleophobic material. In this way, an adhesion of the contaminants on the slidable member may be reduced or avoided. The hydrophobic and/or oleophobic material may be provided as a material at the surface of the slidable member such that a contact angle of the contaminant, in particular a liquid such as water or a lipid such as oil, to the surface is larger than 45°, in particular larger than 60°. In some implementations, the slidable member comprises a surface tapering toward a surface along which the slidable movement of the slidable member between the first and second position is provided. Such a tapering may support scraping off the contaminants from the surface during the repetitive movement of the slidable member and/or may favor a transport of the contaminants in a direction toward which the surface of the slidable member comprising the tapering is oriented. In particular, the surface of the slidable member may have a wedge shape in a direction in which the slidable member is moveable toward the opening.

Different types of a hearing device can be distinguished by a position at which they are worn at the ear. Some hearing devices, such as behind-the-ear (BTE) hearing aids and receiver-in-the-canal (RIC) hearing aids, typically comprise an earpiece configured to be at least partially inserted into an ear canal of the ear, and an additional housing configured to be worn at a wearing position outside the ear canal, in particular behind the ear of the user. Some other hearing devices, as for instance earbuds, earphones, hearables, earplugs, in-the-ear (ITE) hearing aids, invisible-in-the-canal (IIC) hearing aids, and completely-in-the-canal (CIC) hearing aids, commonly comprise such an earpiece to be worn at least partially inside the ear canal without an additional housing for wearing at the different ear position.

FIG. 1 illustrates an exemplary implementation of a hearing device 101 as a RIC hearing aid. RIC hearing aid 101 comprises a BTE part 121 configured to be worn at an ear at a wearing position behind the ear, and an ITE part 111 configured to be worn at the ear at a wearing position at least partially inside an ear canal of the ear.

ITE part 111 is an earpiece comprising a housing 114 at least partially insertable into an ear canal. Housing 114 encloses an interior space in which an acoustic output transducer 117 configured to generate sound waves is provided. Output transducer 117 can thus be acoustically coupled to an inner region of the ear canal when earpiece 111 is at least partially inserted into the ear canal in order to emit the sound waves into the inner region of the ear canal toward the tympanic membrane. Output transducer 117 may be implemented as a receiver, for instance a moving coil speaker or a balanced armature transducer. Earpiece 111 may further comprise a sealing member 115 adapted to contact an ear canal wall when earpiece 111 is at least partially inserted into the ear canal. Sealing member 115 may be a flexible member configured to conform to the shape of the ear canal wall. For instance, the flexible member may have a shape of a dome. Sealing member 115 may also be provided by a shell having a shape customized to an individual ear canal. An acoustical seal with the ear canal wall may thus be provided at the earpiece portion contacting the ear canal wall. The inner region of the ear canal may be defined as a region between the acoustical seal, as provided by sealing member 115 at the ear canal wall, and the tympanic membrane, when housing 114 at least partially insertable into the ear canal. The acoustical seal may at least partially block ambient sound from entering the inner region of the ear canal and/or the sound waves generated by output transducer 117 from entering an ambient environment outside the ear canal.

Housing 114 is further provided with an opening leading to an interior space enclosed by housing 114. For instance, the opening may be a sound outlet for emitting the sound waves generated by output transducer 117 into the inner region of the ear canal or any other opening provided at housing 114. Earpiece 111 is further provided with a slidable member moveable relative to the opening and/or relative to a component contained in the interior space, for instance relative to output transducer 117, between different positions including a first position and a second position. Earpiece 111 is further provided with an actuator configured to actuate the movement of the slidable member forth from the first position to the second position, and back from the second position to the first position, in particular by providing a respective actuation force for the movement of the slidable member between the different positions. Various exemplary configurations of the slidable member and the actuator are described in the description that follows.

BTE part 121 comprises a BTE housing 124 configured to be worn behind the ear. BTE part 121 and earpiece 111 are interconnected by a cable 119. A processor 126 accommodated in an interior space enclosed by BTE housing 124 is communicatively coupled to output transducer 117 via cable 119 and a cable connector 129 provided at BTE housing 124. Processor 126 can thus be configured to provide an audio signal to output transducer 117 based on which the sound is generated. Processor 126 can also be communicatively coupled to the actuator of the slidable member included in earpiece 111 via cable 119 and cable connector 129. Processor 126 can then be functional as a controller of the actuator of the slidable member included in earpiece 111. The controller can be configured to provide a control signal to the actuator of the slidable member in order to actuate a movement of the slidable member between the different positions. In the illustrated example, processor 126 is further operatively connected to a sound sensor 127, which may be implemented by a microphone and/or a microphone array, and a user interface 128, for instance a switch. BTE part 121 further includes a battery 123 as a power source for the above described components. Battery 123 may be a rechargeable battery. BTE part 121 may then further comprise a charging port for battery 123 at which battery 123 can be connected to a charging station. Hearing devices 101 may include additional or alternative components as may serve a particular implementation.

A user may operate controller 126 to control the actuator of the slidable member to actuate a movement of the slidable member between the different positions via user interface 128. Controller 126 may also control the actuator of the slidable member to actuate a movement of the slidable member between the different positions depending on other parameters, which may be determined by a programme executed by the controller when implemented by processor 126. The programme may define at least one operational mode of controller 125 for controlling the actuator of the slidable member, or a plurality of different operational modes in which the actuator of the slidable member is controlled in different ways. The programme may be stored in a computer-implemented medium, in particular a non-transitory computer-implemented medium, which can be accessed by processor 126, for instance a memory, which may include a non-volatile memory. The parameters may include, for instance, properties of an audio signal provided to output transducer 117 and/or sensor data detected by a sensor, for instance sound sensor 127, information about a charging status of battery 123 and/or information indicative of whether the hearing device is removed from the ear canal, which may be based on an acoustic feedback detected by sound sensor 127, and/or information whether the hearing device is disposed in a stationary device, which may include information whether the hearing device is connected to a charging station. Controller 126 is configured, in at least one operational mode, to control the actuator of the slidable member to actuate the slidable member to repetitively move forth and back between the first and second position at a predetermined repetition rate. Such a repetitive movement of the slidable member may be exploited to provide a cleaning functionality of hearing device 101. These and other operations, which can be controlled by controller 126, are further described in the description that follows.

Figure 2A:
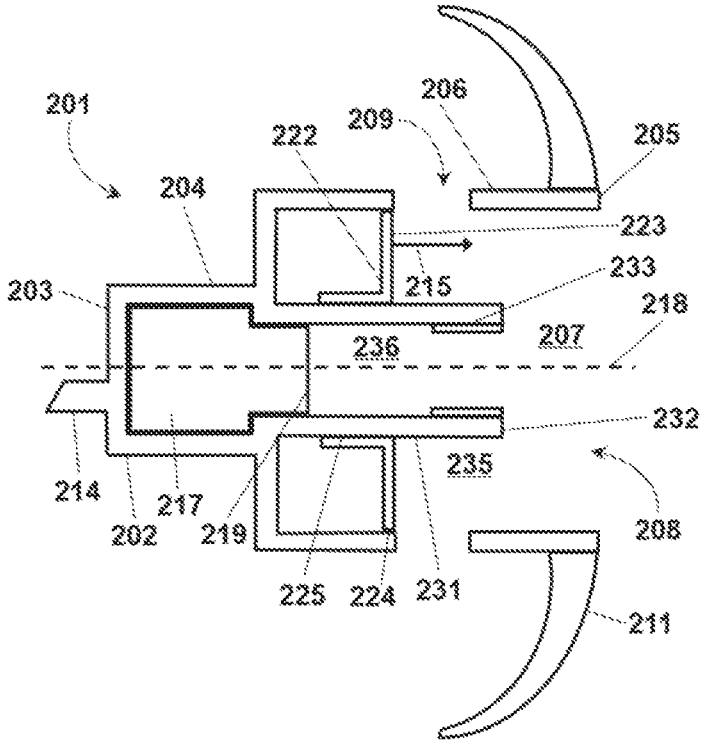
FIGS. 2A, B schematically illustrate some embodiments of an earpiece including a slidable member in a first position and in a second position.
Figure 2B:
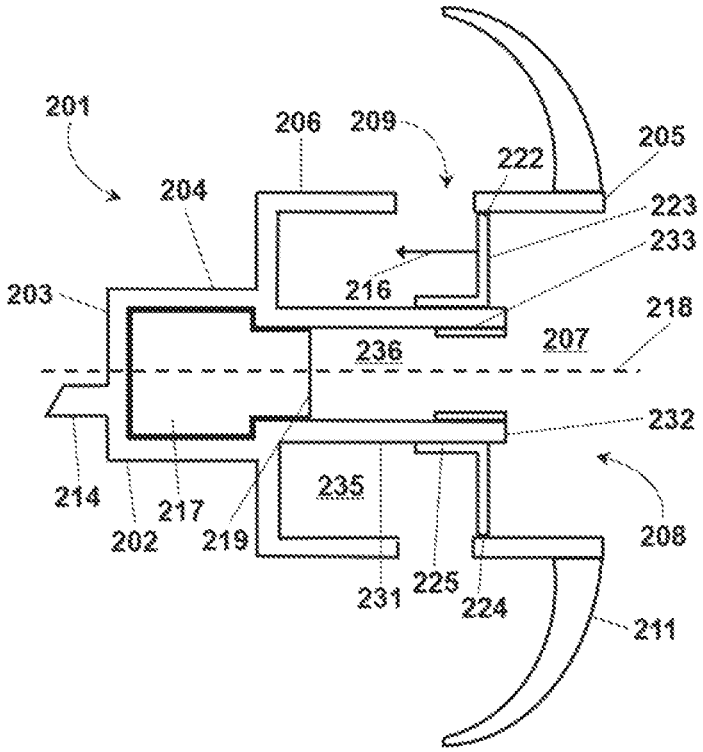

FIGS. 2A and 2B illustrate an earpiece 201 of a hearing device in accordance with some embodiments of the present disclosure. For example, earpiece 111 of hearing device 101 depicted in FIG. 1 may be implemented by earpiece 201. Earpiece 301 comprises a housing 202 configured to be at least partially inserted into an ear canal. Housing 302 comprises an outer wall 204 delimiting an interior space 207 from an exterior of housing 202. Outer wall 204 comprises a side wall 206 extending in a direction of the ear canal when housing 202 is at least partially inserted into the ear canal. Side wall 206 has a circumference surrounding a longitudinal axis 218 of housing 202. Longitudinal axis 218 extends in a direction in which housing 202 is insertable into the ear canal. Housing 202 has an opening 209. Opening 209 is provided as a through-hole in side wall 206. Opening 209 connects interior space 207 with the exterior of housing 202.

Outer wall 204 further comprises a front wall 205 at a front end of housing 202. Front wall 205 faces the tympanic membrane in the ear canal when housing 202 is at least partially inserted into the ear canal. Front wall 205 has an opening 208. Opening 208 connects interior space 207 with the exterior of housing 202. Opening 208 in front wall 205 constitutes a first opening, and opening 209 in side wall 206 constitutes a second opening. Interior space 207 can be acoustically coupled with the exterior of housing 202 through first opening 208 and through second opening 209.

Earpiece 201 further comprises a sealing member 211. Sealing member 211 is configured to contact the ear canal wall when housing 202 is at least partially inserted into the ear canal. Sealing member 211 can thus form an acoustical seal with the ear canal wall such that an inner region of the ear canal between sealing member 211 and the tympanic membrane is acoustically isolated from the ambient environment outside the ear canal, at least to a certain degree. An outer region of the ear canal extends in a region between an entrance of the ear canal at the ambient environment and sealing member 211. Sealing member 211, as illustrated, can be provided as a flexible member configured to conform to an individual ear canal shape. For instance, the flexible member can have a dome-like shape, in particular a mushroom like shape. In other instances, sealing member 311 can also be provided as a contoured member having an outer shape customized to an individual ear canal shape. For instance, the contoured member may be a shell having a shape customized to an individual ear canal.

First opening 208 leads from the inner region of the ear canal to interior space 207 when housing 302 is at least partially inserted into the ear canal. Second opening 309 leads from the outer region of the ear canal to interior space 207 when the earpiece is at least partially inserted into the ear canal. Contaminants prevailing in the ear canal can thus settle down at each housing wall 205, 206, in particular at a portion of housing wall 205, 206 adjacent to a respective opening 208, 209, and/or enter interior space 207 through opening 208, 209. First opening 208 and second opening 209 are acoustically coupled through interior space 207. Sealing member 211 is disposed at an external surface of housing 202 between first opening 208 and second opening 209 such that a venting channel extends through interior space 207 of housing 202 between first opening 208 and second opening 209. The venting channel can provide for a venting between the inner region of the ear canal and the ambient environment outside the ear canal when housing 202 is at least partially inserted into the ear canal. Contaminants settling down at openings 208, 209 and/or at the venting channel extending through interior space 207, however, can negatively impact the venting through the venting channel.

A rear wall 203 is provided at a rear end of housing 202. Rear wall 203 is closed. An output transducer 217 is accommodated in a rear portion of interior space 207 of housing 202 in front of rear wall 203. A sound output 219 of output transducer 217 is provided at a front side of output transducer 217 opposing rear wall 203. Output transducer 217 is thus acoustically coupled to a front portion of interior space 207 surrounded by side wall 206. For instance, output transducer 217 may be implemented as a moving coil driver or a balanced armature transducer. The front portion of interior space 207 provides a sound conduit through which sound emitted from sound output 219 can propagate toward opening 208 at the front end of housing 202 along longitudinal axis 218. Opening 208 thus constitutes a sound outlet for the sound waves generated by output transducer 217. Sound waves can be emitted into the inner region of the ear canal through the sound outlet, when housing 202 is at least partially inserted into the ear canal. In the illustrated example, the venting channel provided between first opening 208 and second opening 209 extends through the sound conduit. Contaminants entering interior space 207 through openings 208, 209 can negatively affect the sound delivered through the sound conduit and/or can harm output transducer 217 and/or other components provided in interior space 207.

Earpiece 201 further comprises a slidable member 222. Slidable member 222 is moveably coupled with housing 202 such that it can be moved between a first position, as illustrated in FIG. 2A, and a second position, as illustrated in FIG. 2B, relative to openings 208, 209. A first activation force 215 for activating a movement of slidable member 222 from the first position to the second position is schematically indicated in FIG. 2A as a vector, and a second activation force 216 for activating a movement of slidable member 222 from the second position to the first position is schematically indicated in FIG. 2B as another vector. In the illustrated example, activation forces 215, 216 point in a moving direction of slidable member 222 when activation forces 215, 216 act on slidable member 222. The moving direction 215 illustrated in FIG. 2A corresponds to a forth movement of slidable member 222, and the moving direction 216 illustrated in FIG. 2B corresponds to a back movement of slidable member 222.

Slidable member 222 comprises a front surface 223 oriented in the direction in which slidable member 222 is moveable between the first position and the second position. Front surface 223 faces first opening 208. Front surface 223 faces in a transverse direction relative to second opening 209. A distance of front surface 223 from first opening 208 is decreased in the second position of slidable member 222 as compared to the first position. A trajectory of the movement of slidable member 222 between the first position and the second position extends across second opening 209. Contaminants inside interior space 207 can thus be transported to second opening 209 and/or toward first opening 208 by the movement of slidable member 222 between the first position and the second position.

Housing 202 encloses a support 231 for slidable member 222. Slidable member 222 is slidable along support 231 during the movement between the first position and second position of slidable member 222. In the illustrated example, support 231 is provided as an inner wall of housing 202 extending through interior space 207 in a direction of longitudinal axis 218. Along its longitudinal extension, inner wall 231 divides interior space 207 in an outer volume portion 235 having a radial distance from longitudinal axis 218 and an inner volume portion 236 through which longitudinal axis 218 extends. Contaminants can thus enter outer volume portion 235 through second opening 209. Contaminants can also enter outer volume portion 235 and inner volume portion 236 through first opening 208. The venting channel between first opening 208 and second opening 209 extends through outer volume portion 235 and a remaining portion of interior space 207. The sound conduit through which sound generated by output transducer 217 can propagate from sound output 219 toward sound outlet 208 at the front end of housing 202 extends through inner volume portion 236 and a remaining portion of interior space 207. Slidable member 222 is provided in the venting channel, in particular in outer volume portion 235 of interior space 207. A front end 232 of support 231 has a distance from first opening 208. The sliding movement of slidable member 222 is thus limited with regard to a spacing of slidable member 222 from first opening 208 in all the positions of slidable member 222.

Slidable member 222 comprises an inner surface 225 oriented in a radially inward direction toward longitudinal axis 218, and an outer surface 224 oriented in a radially outward direction. Inner surface 225 adjoins support 231. Outer surface 224 adjoins side wall 206. Outer surface 224 moves across second opening 209 during the movement of slidable member 222 between the first position and the second position. Front surface 223 of slidable member 222 extends between side wall 206 and support 231. Contaminants settling down at side wall 206 and/or opening 209 and/or support 231 can thus be detached by a repetitive movement of slidable member 222 between the first position and the second position at a constant repetition rate. For instance, contaminants such as cerumen encrusting on an inner surface of side wall 206 and/or on a surface of support 231 can be scraped off by a portion of front surface 223 adjoining the respective surface of housing 202 during the repetitive movement of slidable member 222. After contaminants have been detached from side wall 206 and/or opening 209 and/or support 231, they can be transported at front surface 223 of slidable member 222 to second opening 209 and/or toward first opening 208 facilitating their removal from interior space 207. A circulation of air through openings 208, 209, which may be produced or enhanced by the repetitive movement of slidable member 222, may further assist in the removal of the contaminants from interior space 207.

In the first position of slidable member 222, as illustrated in FIG. 2A, front surface 223 of slidable member 222 is positioned behind second opening 209 such that it has a larger distance from first opening 208 at front end 205 of housing 202. Sound waves can thus pass through the venting channel between first opening 208 leading from interior space 207 to the inner region of the ear canal and second opening 209 leading from interior space 207 to the ambient environment outside the ear canal. In the second position of slidable member 222, as illustrated in FIG. 2B, front surface 223 of slidable member 222 is positioned in front of second opening 209 such that it has a smaller distance to first opening 208 at front end 205 of housing 202. The venting channel is then closed at the position of front surface 223 of slidable member 222 such that sound waves are blocked from passing through the venting channel between first opening 308 and second opening 309. In this way, an effective size of the venting channel of the venting channel can be adjusted by the movement of slidable member 222 between the first and second position. In the first position of slidable member 222, the effective size of the venting channel is more enlarged as compared to the second position of slidable member 222. In the illustrated example, the venting channel is fully reduced in the second position of slidable member 222. Correspondingly, an acoustic impedance of the venting channel can be adjusted by the movement of slidable member 222. The acoustic impedance of the venting channel is decreased in the first position of slidable member 222, in which the effective size of the venting channel is more enlarged, as compared to the second position of slidable member 222, in which the effective size of the venting channel is more reduced.

Earpiece 201 further comprises an actuator 233 of slidable member 222. Actuator 233 is configured to actuate the movement of slidable member 222 forth from the first position to the second position, and back from the second position to the first position. Actuator 233 can be configured to provide first activation force 215 to actuate the forth movement of slidable member 222, and second activation force 216 to actuate the back movement of slidable member 222. For instance, activation forces 215, 216 may be provided with an opposite direction and an equal magnitude acting on slidable member 222, as illustrated in FIGS. 2A, B.

In some instances, actuator 233 can be an electric and/or magnetic actuator. The actuation force may then be provided by an electric and/or magnetic interaction of actuator 233 with slidable member 222. For instance, actuator 233 can be configured to provide a magnetic field, by which magnetic field the actuation force acting on slidable member 222 is provided. To this end, actuator 233 can comprise a first magnetic member and slidable member 222 can comprise a second magnetic member configured to interact with the first magnetic member via the magnetic field. For instance, as illustrated, actuator 233 can comprise a coil. Providing a current through the coil can produce a magnetic field depending on the provided current. A magnetic flux produced in the coil by the current can thus be changed by changing the current. Changing a polarity and/or an amount of the current through the coil can thus provide the actuation force to actuate the movement of slidable member 222 in the different directions between the different positions. Various configurations of the actuator providing the actuation force based on magnetic field interaction with the slidable member are described in patent application publication Nos. WO 2019/056715 A1 and EP 3 471 432 A1 in further detail. Actuation of the movement of slidable member 222 can also be based on other interaction types of actuator 233 and slidable member 222 which may include, for instance, actuation by an electrical field and/or transmission of a mechanical force and/or a pressure transfer and/or an actuation of a piezoelectric force.

Earpiece 201 further comprises a connector 214. Via connector 214, a controller is connectable to actuator 233. The controller, for instance processor 125, may also be connected to output transducer 217 via connector 214. A power source, for instance battery 123, may also be connected to actuator 233 and/or output transducer 217 via connector 214.

Actuating the movement of slidable member 222 between the first and second position can thus be employed for different purposes. On the one hand, the effective size of the venting channel leading through interior space 207 between first opening 308 and second opening 309 can be adjusted by a single movement of slidable member 222 between the first and second position relative to the venting channel. Actuation of such a movement of slidable member 222 by actuator 233 may be controlled by controller 125 in a first mode of operation. On the other hand, a transport and/or detachment of contaminants at opening 209 and/or inside interior space 207 can be provided by the repetitive movement of slidable member 222 forth and back between the first and second position. Actuation of such a repetitive movement of slidable member 222 by actuator 233 may be controlled by controller 125 in a second mode of operation. Employing the slidable member 222 for the different purposes can contribute to a more compact design of earpiece 201, which can be vital for saving valuable space available inside the ear canal, and can allow minimizing associated constructional efforts and costs.

Figure 3A:
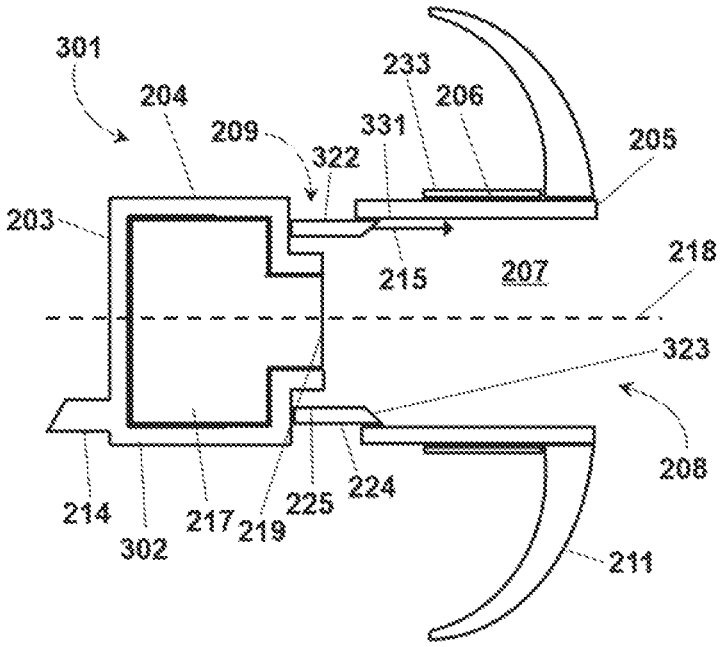
FIGS. 3A, B schematically illustrate some further embodiments of an earpiece including a slidable member in a first position and in a second position.
Figure 3B:
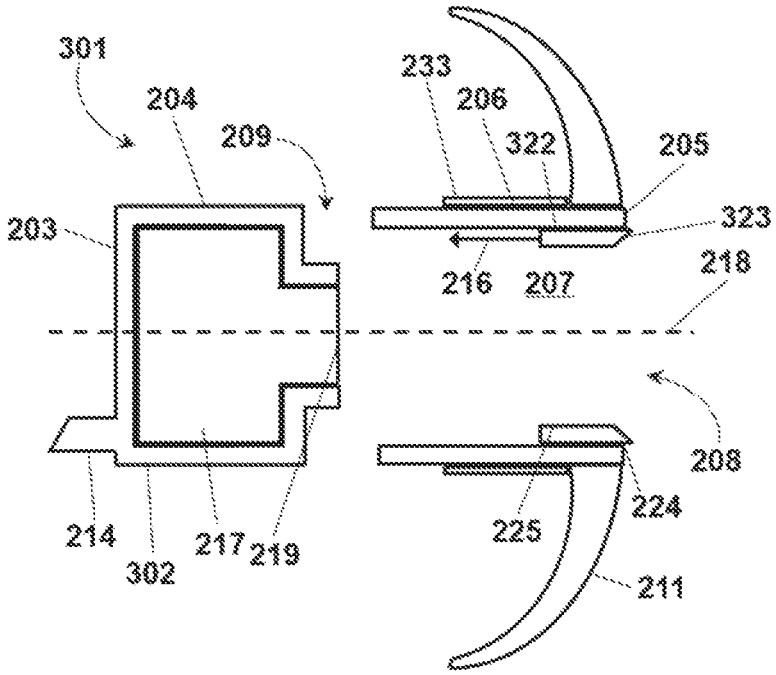

FIGS. 3A and 3B illustrate an earpiece 301 of a hearing device in accordance with some embodiments of the present disclosure. For example, earpiece 111 of hearing device 101 depicted in FIG. 1 may be implemented by earpiece 301. Earpiece 301 comprises a housing 302 configured to be at least partially inserted into an ear canal. Earpiece 301 further comprises a slidable member 322. Slidable member 322 is moveably coupled with housing 302 such that it can be moved between a first position, as illustrated in FIG. 3A, and a second position, as illustrated in FIG. 3B, relative to openings 208, 209. In the illustrated example, the effective size of the venting channel extending between first opening 208 and second opening 209 is more reduced in the first position of slidable member 322, and more enlarged in the second position of slidable member 222. In the illustrated example, both the venting channel between first opening 208 and second opening 209, and the sound conduit between sound output 219 of output transducer 217 and first opening 208 providing the sound outlet from housing 302 occupy an equal portion of interior space 207. Slidable member 322 is disposed in the venting channel and in the sound conduit.

A sliding movement of slidable member 322 forth and back between the first position and the second position extends along an inner surface 331 of side wall 206. A support for slidable member 222 at housing 302 along which slidable member 222 can be moved may thus be provided at inner surface 331. In particular, outer surface 224 of slidable member 322 may be supported at inner surface 331 of side wall 206. In the illustrated example, the movement of slidable member 322 between the first position and the second position extends along a portion of side wall 206 at which inner surface 331 is exposed to interior space 207. In particular, in the second position of slidable member 322, as illustrated in FIG. 3B, slidable member 322 is placed at first opening 208. In the first position of slidable member 322, as illustrated in FIG. 3A, slidable member 322 is placed at a maximum distance from first opening 208 inside interior space 207. Contaminants entering interior space 207 and condensing at inner surface 331 may thus be removed over a major part of the portion of side wall 206 which is exposed to the contaminants.

A front surface 323 of slidable member 322 oriented in the direction in which slidable member 222 is moveable between the first position and the second position faces first opening 208. At front surface 323, slidable member 322 tapers toward inner surface 331 of side wall 206. The tapering of slidable member 322 at front surface 323, resulting in a conical form of slidable member 322 at front surface 323, can facilitate the removal of contaminants from inner surface 331 of side wall 206. In particular, scraping off contaminants encrusted at inner surface 331 of side wall 206 can be benefited by the tapered shaped. In some instances, a tapering of slidable member 322 may be predominantly provided at front surface 323. To illustrate, a surface of slidable member 322 opposing front surface 323, in particular a surface of slidable member 222 oriented in the direction in which slidable member 222 is moveable from the second position to the first position, may be substantially flat. In this way, a removal of contaminants from inner surface 331 of side wall 206 may be predominantly effective during the forth movement of slidable member 322, or at least less effective during the back movement of slidable member 322 as compared to the forth movement. In this way, a transport of the removed contaminants toward first opening 208 during the forth movement of slidable member 322 may be facilitated.

Figure 4A:
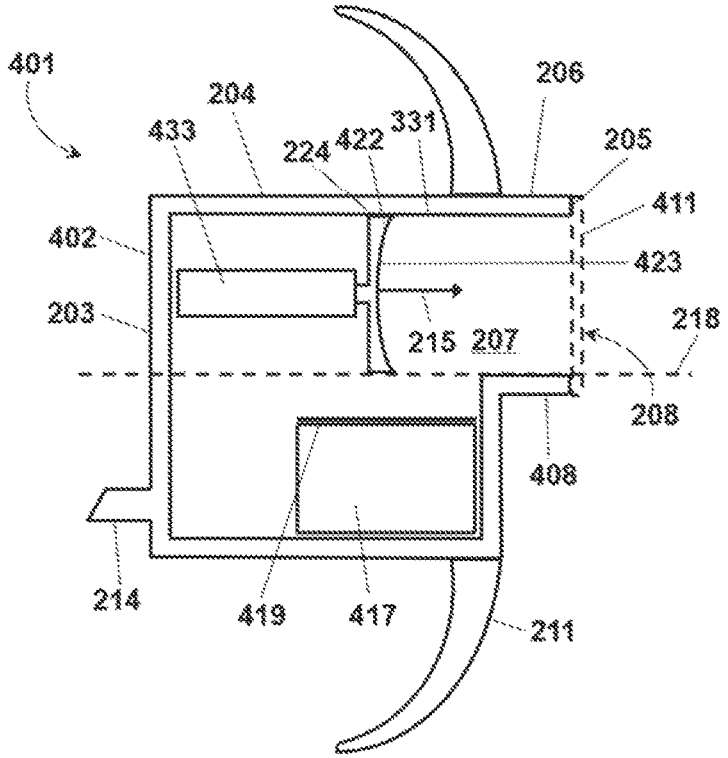
FIGS. 4A, B schematically illustrate some further embodiments of an earpiece including a slidable member in a first position and in a second position.
Figure 4B:
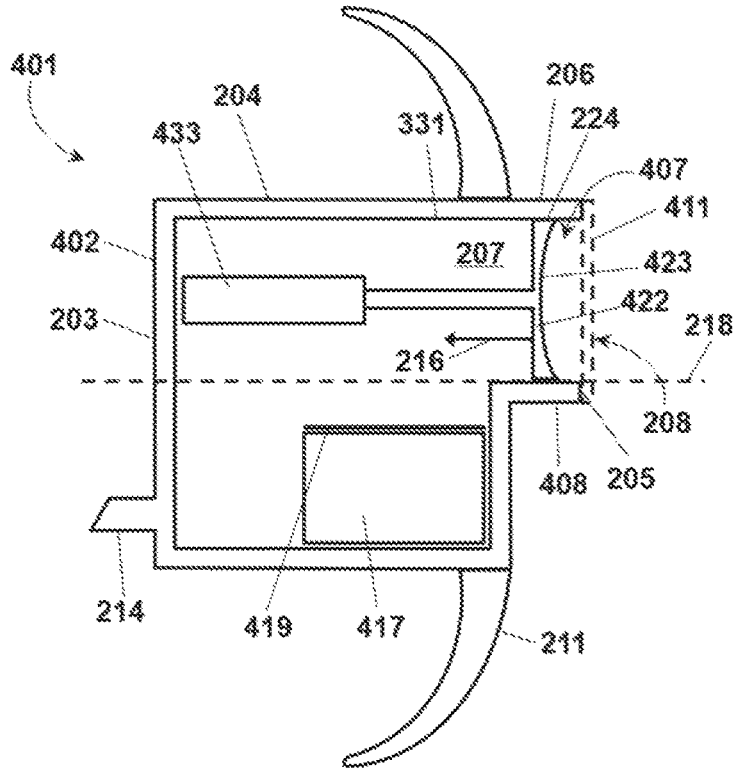

FIGS. 4A and 4B illustrate an earpiece 401 of a hearing device in accordance with some embodiments of the present disclosure. For example, earpiece 111 of hearing device 101 depicted in FIG. 1 may be implemented by earpiece 401. Earpiece 401 comprises a housing 402 configured to be at least partially inserted into an ear canal. Housing 402 comprises a spout 408 leading to the sound outlet provided by opening 208. In the illustrated example, spout 408 is implemented as a tubular portion of housing 402 having a smaller diameter as compared to a diameter of a cross section of a main portion of housing 402 in which at least one component is accommodated. Interior space 207 is enclosed by the main portion of housing 402 and spout 408. In the illustrated example, sound outlet 208 constitutes a single opening of housing 402.

Earpiece 401 further comprises a cerumen filter 411. Cerumen filter 411, also often referred to as an earwax filter, is disposed at opening 208 of spout 408. Cerumen filter 411 can prevent, at least to a certain extent, cerumen from entering interior space 207 through opening 208 when housing 402 is at least partially inserted into an ear canal.

Earpiece 401 further comprises an output transducer 417 accommodated in a lateral portion of interior space 207. In the illustrated example, output transducer 417 is a balanced armature transducer. A membrane 419 of output transducer 417 constitutes a sound output at which sound waves are generated. For example, membrane 419 faces longitudinal axis 218. Interior space 207 constitutes a sound conduit for the sound waves. Sound waves emitted from sound output 419 can thus be emitted through spout 408 and opening 208 into the ear canal, when housing 402 is at least partially inserted into the ear canal.

Earpiece 401 further comprises a slidable member 422, and an actuator 433 for actuating a movement of slidable member 422 forth and back between a first position, as illustrated in FIG. 4A, and a second position, as illustrated in FIG. 4B, of slidable member 422. In the illustrated example, actuator 433 is implemented as a cylinder-piston system, wherein slidable member 422 is attached to the piston. For instance, actuator 433 may comprise a hydraulic cylinder and/or a pneumatic cylinder to provide mechanical actuation forces 215, 216 for the movement of slidable member 422. Outer surface 224 of slidable member 422 can thus be slid along inner surface 331 of side wall 206 between the first and second position. A support of slidable member 422 during the sliding movement can be provided by the mechanical attachment to actuator 433.

A front surface 423 of slidable member 422 oriented in the direction in which slidable member 422 is moveable from the first to the second position faces opening 208. In the illustrated example, slidable member 422 is disposed between actuator 433 and opening 208 to provide the forth movement of slidable member 222 toward opening 208 by means of the cylinder-piston system of actuator 433. Slidable member 422 can thus be moved from the first position distant from spout 408 to the second position in which slidable member 422 is positioned within spout 408. In some instances, a cross section of slidable member 422, in particular an area covered by front surface 423, matches a cross section of interior volume 207 enclosed by spout 408. Contaminations settling down on inner surface 331 of spout 408 can thus be effectively removed along a complete inner circumference of spout 408. For instance, as illustrated, front surface 423 may be provided with a taper toward inner surface 331 of spout 408 to further facilitate scraping off the contaminations for spout 408 during the forth movement of slidable member 422. Moreover, providing front surface 423 substantially covering the cross sectional area enclosed by spout 408 can allow to efficiently transport the contaminations at front surface 423 toward opening 208.

In the second position of slidable member 422, as illustrated in FIG. 4B, slidable member 422 is positioned closer to opening 208 as compared to the first position of slidable member 422, as illustrated in FIG. 4A. But even in the second position, slidable member 422 is spaced at a distance from opening 208, at which cerumen filter 411 is provided. In this way, an outer volume portion 407 of interior space 207 can be provided between front surface 423 of slidable member 422 in the second position of slidable member 422 and opening 208. Contaminations transported by slidable member 422 toward opening 208 can thus be accumulated in outer volume portion 407 leading to opening 208. The contaminations accumulated in outer volume portion 407 can then be easily removed from outer volume portion 407, for instance by manually reaching into opening 208 after removal of cerumen filter 411.

Figure 5A:
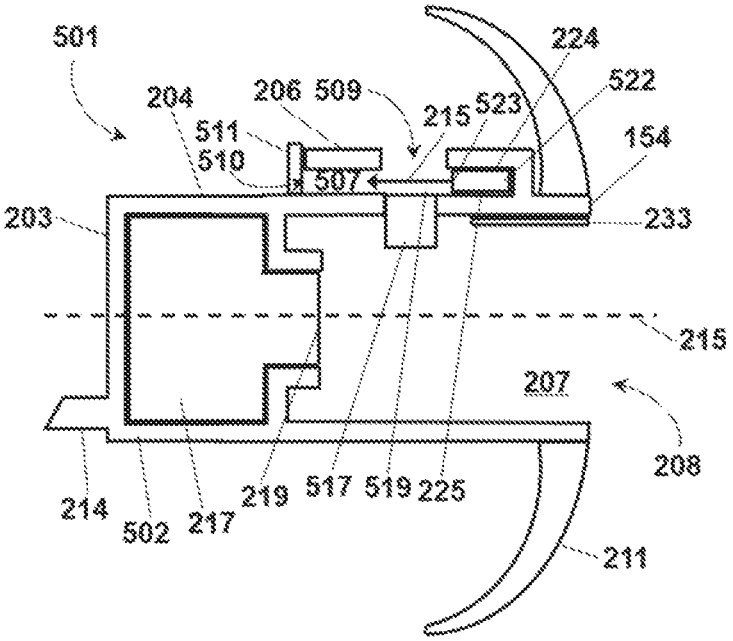
FIGS. 5A, B schematically illustrate some further embodiments of an earpiece including a slidable member in a first position and in a second position.
Figure 5B:
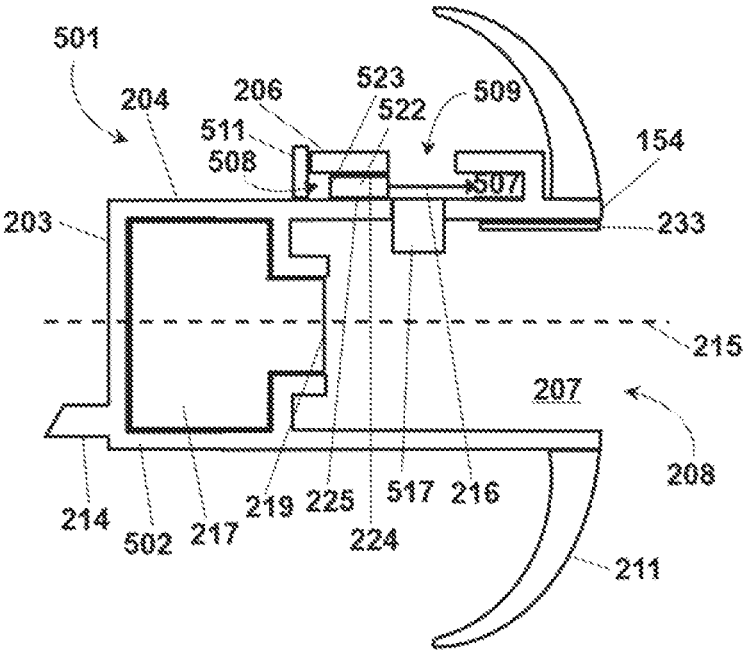

FIGS. 5A and 5B illustrate an earpiece 501 of a hearing device in accordance with some embodiments of the present disclosure. For example, earpiece 111 of hearing device 101 depicted in FIG. 1 may be implemented by earpiece 501. Earpiece 501 comprises a housing 502 configured to be at least partially inserted into an ear canal. Earpiece 501 further comprises a sensor 517 configured to detect a property inside the ear canal. For instance, sensor 517 may be implemented as an ear canal microphone. Sensor 517 may also be implemented as a photodetector of a photoplethysmogram (PPG) sensor. A light emitter of the PPG sensor may be provided next to the photodetector or at a different position at housing 502. Housing 502 comprises an opening 509 in front of a sensing interface 519 of sensor 517. For instance, sensing interface 519 may be a membrane of an ear canal microphone or an active area of a photodetector. Opening 509 permits sensor 517 to detect a property of the environment outside housing 502 via sensing interface 519. Opening 509 is provided at a distance from sensing interface 519. Thus, a volume portion 507 of interior space 207 enclosed by housing 502 is provided between opening 509 and sensing interface 519. Volume portion 507 is referred to as an intermediate space between opening 509 and sensing interface 519. In the illustrated example, opening 509 is provided in side wall 206 of housing 502. Opening 509 is a second opening in addition to first opening 208 constituting the sound outlet for the sound waves generated by output transducer 217.

Earpiece 501 further comprises a slidable member 522 provided in intermediate space 507 moveable between a first position, as illustrated in FIG. 5A, and a second position, as illustrated in FIG. 5B. Inner surface 225 of slidable member 522 moves across sensing interface 519 during the movement between the first and second position. Outer surface 224 of slidable member 522 moves across second opening 509 during the movement between the first and second position. Thus, contaminants settling down at sensing interface 519 and/or at second opening 509 can be removed by the forth and back movement of slidable member 522. A front surface 523 of slidable member 522 oriented in the direction in which slidable member 522 is moveable from the first to the second position faces in a transverse direction relative to second opening 509. A third opening 510 is provided at a portion of housing 502 facing front surface 523 of slidable member 522. Contaminants removed by the forth and back movement of slidable member 522 can thus be transported toward third opening 510 at front surface 523 of slidable member 522.

Third opening 510 is closed by a cover 511 preventing contaminants from entering intermediate space 507 through third opening 510. In the second position of slidable member 522, as illustrated in FIG. 5B, in which front surface 523 has its closest position to third opening 510, front surface 523 still has a distance from third opening 510. Thus, an outer volume portion 508 of intermediate space 507 is provided over this distance in which contaminations transported by slidable member 422 can be accumulated. The accumulated contaminations can then be extracted from intermediate space 507 after removal of cover 511.

Figure 6:
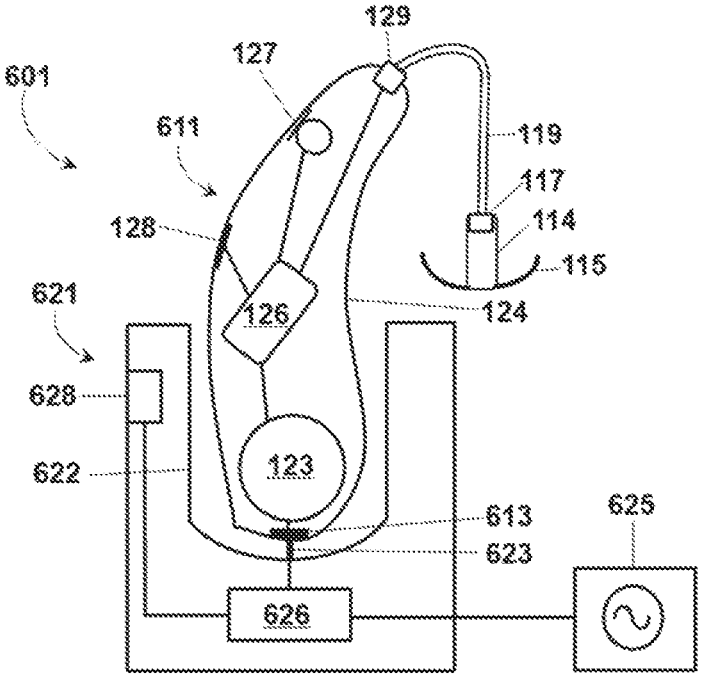
FIGS. 6, 7 schematically illustrate some embodiments of a hearing system comprising a hearing device and a stationary device in which the hearing device can be disposed.

FIG. 6 illustrates a hearing system 601 comprising a hearing device 611 and a stationary device 621 in accordance with some embodiments of the present disclosure. Hearing device 611 may be implemented, for instance, as RIC hearing aid 101 illustrated in FIG. 1. Stationary device 621 is configured such that hearing device 611 can be mounted to stationary device 621. In the illustrated example, stationary device 621 is configured such that hearing device 611 can be disposed in stationary device 621. To this end, stationary device 621 comprises a retainer 622 for hearing device 611 in which hearing device 611 can be mounted at a fixed position. In other examples, stationary device 621 may not comprise a dedicated disposal area for hearing device 611 at which hearing device 611 can be disposed during the mounting. For instance, the mounting between hearing device 611 and stationary device 621 may be provided by a cable of stationary device 621 plugged into hearing device 611. Hearing device 611 may then be disposed at a storage place in proximity to stationary device 621.

Stationary device 621 is a charging station for rechargeable battery 123 included in hearing device 611. Charging station 621 is connected to a power source 625. In particular, charging station 621 comprises a charging plug 623 connected to power source 625. Hearing device 611 comprises a charging plug 613 connected to rechargeable battery 123. Hearing device 611 can be mounted to charging station 621 by plugging charging plug 613 of hearing device 611 into charging plug 623 of charging station 621.

In some instances, as illustrated, charging station 621 further comprises a charge controller 626. Charge controller 626 may be configured to communicate with controller 126 of hearing device. For example, information about a charging status of battery 123 may be communicated from charge controller 626 to controller 126 of hearing device 611. In some instances, the charge controller, in particular a power management controller, may be implemented in hearing device 611. For example, controller 626 of hearing device may include a charge controller configured to determine a charging status of battery 123.

In some instances, as illustrated, charging station 621 further comprises a user interface 628. Via user interface 628, a user may interact with charging station 621 and/or hearing device 611 when hearing device 611 is mounted to charging station 621. For instance, a user may select a charging mode via user interface 628. A user may also select a mode of operation of hearing device 611 performed during the mounting of hearing device 611 to charging station 621. Such a mode of operation may comprise, for instance, controlling an actuator of a slidable member in housing 114 to actuate a repetitive forth and back movement of the slidable member.

Controller 126 of hearing device 611 can also be configured to gather information whether hearing device 611 is mounted to charging station 621, and to control the actuator to actuate the repetitive movement of the slidable member depending thereon. For instance, the information can comprise a signal indicating that charging plug 613 of hearing device 611 is connected to charging plug 623 of charging station 621. In particular, controller 126 of hearing device 611 may be configured to gather information about a connection with charge controller 626 of charging station 621. In this way, the actuating the repetitive movement of the slidable member may be automatically performed without any interaction of the user required except the mounting of hearing device 611 to charging station 621.

A cleaning functionality of hearing device 611 provided by the repetitive movement of the slidable member can thus be integrated in a usage routine of hearing device 611 requiring a regular charging of battery 123, namely during the charging of battery 123. An additional effort by the user for the cleaning can then be kept low, and the user is also not required to wait for an additional time to use hearing device 611 than the time during which the charging takes place. At the same time, an unintended actuation of the repetitive movement of the slidable member when hearing device 611 is worn by the user, in particular when housing 114 is at least partially inserted into the ear canal, can be effectively avoided.

Controller 126 of hearing device 611 can also be configured to gather information about a charging status of battery 123 and to control the actuator to actuate said repetitive movement of the slidable member depending on the charging status. In some instances, the information about the charging status can be determined by hearing device 611. For example, hearing device 611 may comprise a power management controller for battery 123, which may be implemented in controller 126 of hearing device 611. In some instances, the information about the charging status can be provided by charge controller 626 of charging station 621 to controller 126 of hearing device 611. The information about the charging status of battery 123 can then be employed to actuate the repetitive movement of the slidable member only under circumstances in which sufficient power is available from battery 123 to perform such an operation and/or to execute the operation for a desired duration and/or with a desired magnitude of the actuation force acting on the slidable member and/or other energy dependent functionalities of hearing device 611 are not compromised and/or a charging time of battery 123 is not unnecessarily extended. In particular, controller 126 can be configured to control the actuator to actuate the repetitive movement of the slidable member when the charging status of battery 123 exceeds a threshold value. For instance, the repetitive movement of the slidable member may be actuated when battery 123 is fully charged.

Figure 7:
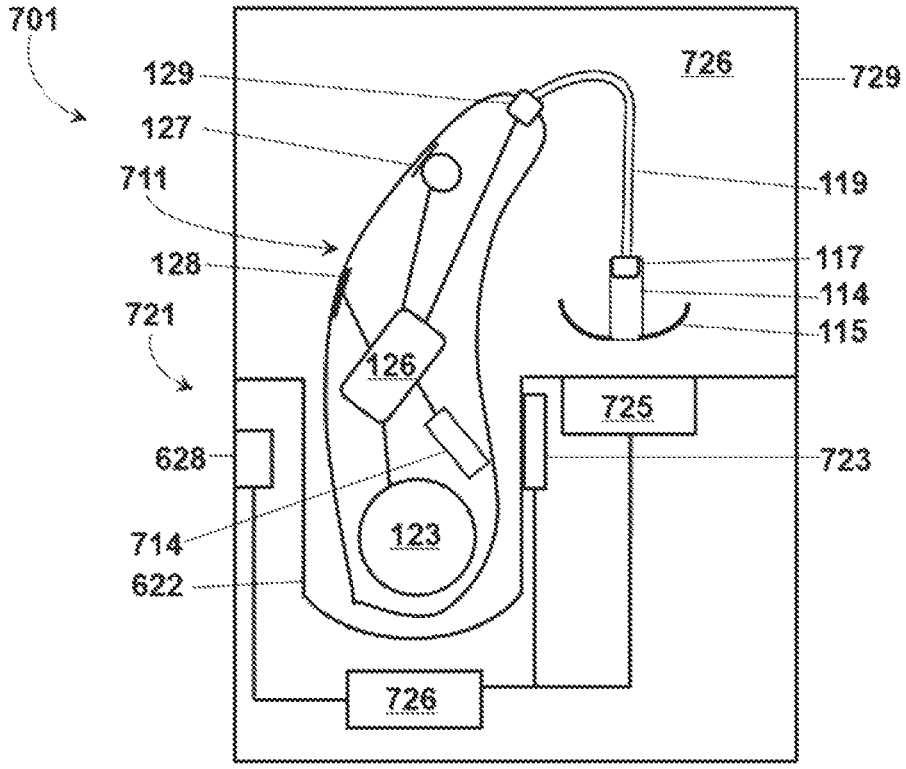

FIG. 7 illustrates a hearing system 701 comprising a hearing device 711 and a stationary device 721 in accordance with some embodiments of the present disclosure. Hearing device 711 may be implemented, for instance, as RIC hearing aid 101 illustrated in FIG. 1. Stationary device 721 is a cleaning station for hearing device 711.

Cleaning station 721 comprises a radiation source 225 configured to emit radiation into an inner volume 726 of cleaning station 721 in which hearing device 711 is disposed. Cleaning station 721 comprises a lid 729 enclosing inner volume 726. In particular, lid 726 can be closed after insertion of hearing device 711 into inner volume 726 in order to shield the ambient environment outside inner volume 726 from the radiation emitted by radiation source 225. The radiation emitted into inner volume 726 is effective to clean and/or disinfect hearing device 711 from contaminants. After a prolonged usage of hearing device 711, contaminants such as particles, bacteria, germs, dust, dirt, cerumen may settle down on an outer surface of hearing device 711 and may also enter an interior space enclosed by housing 114 of hearing device 711 through an opening at housing 114. Radiation source 225 may include a UV-light source. UV light can be particularly effective to remove and/or eliminate the contaminants from hearing device 711.

In some instances, as illustrated, cleaning station 721 further comprises a cleaning controller 726. Cleaning controller 726 can be configured to control a cleaning process performed on hearing device 711, for instance a duration in which the radiation is emitted by radiation source 225 and/or an intensity of the radiation. A user may select and/or activate the cleaning process via user interface 628. The cleaning process may also be performed depending on whether hearing device 711 is mounted to cleaning station 721. For instance, cleaning station 721 may comprise a proximity sensor 723 indicating to cleaning controller 726 whether hearing device 711 is disposed in retainer 622.

Hearing device 711 may comprise a communication unit 714 configured to communicate with cleaning controller 726, for instance via a radio frequency (RF) communication signal. Controller 126 of hearing device 711 may thus gather information from cleaning controller 726, in particular whether hearing device 711 is mounted to cleaning station 721 and/or whether a cleaning process performed on hearing device 711. Controller 126 of hearing device 711 can further be configured to control the actuator of the slidable member to actuate the repetitive movement of the slidable member depending on this information. Actuating the repetitive movement of the slidable member can thus be performed to assist in the cleaning process performed by cleaning station 721, for instance to detach contaminations from the interior space inside housing 114 and/or to transport the contaminations closer to an opening of housing 114 such that the radiation emitted into inner volume 726 of cleaning station 721 can better access the contaminations.

In some implementations, charging station 621, as illustrated in FIG. 6, and cleaning station 721, as illustrated in FIG. 7, may be combined in a single stationary device configured for charging and cleaning of hearing device 101, 611, 711.

Figure 8A:
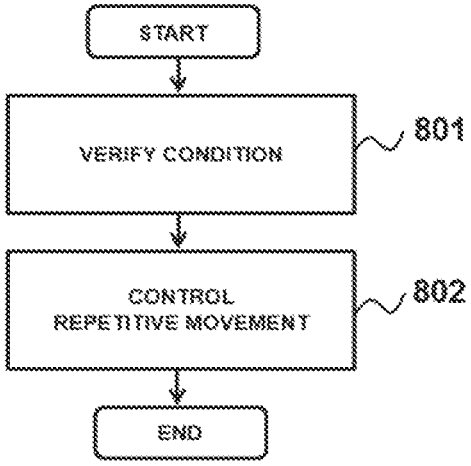
FIG. 8A, B schematically illustrate exemplary methods of operating a hearing device according to principles described herein.

FIG. 8A illustrates a block flow diagram for an exemplary method of operating a hearing device to actuate a movement of a slidable member included in the hearing device. The method may be executed by controller 126 of hearing device 101, 611, 711. At 801, a condition is verified. The condition may indicate a favorable time for actuating a repetitive movement of a slidable member included in an interior space enclosed by housing 114 of hearing device of 101, 611, 711, in particular a favorable time with respect to a routine of usage of hearing device of 101, 611, 711 by a user and/or without compromising a desired functionality of hearing device of 101, 611, 711. The condition may be based, for instance, on information indicative of whether the hearing device is removed from the ear canal. Such information may be obtained, for instance, by an acoustic feedback detected by a microphone included in the housing and/or a movement pattern detected by an accelerometer included in the housing and/or an optical signal detected by an optical sensor included in the housing. The condition may also be based on information whether the hearing device is mounted to a stationary device and/or information about a connection of a controller of the hearing device with a controller of the stationary device. The condition may also be based on information about a charging status of battery 123 included in hearing device 101, 611, 711. At 802, when the condition is verified to be fulfilled, the repetitive movement of the slidable member is actuated.

Figure 8B:
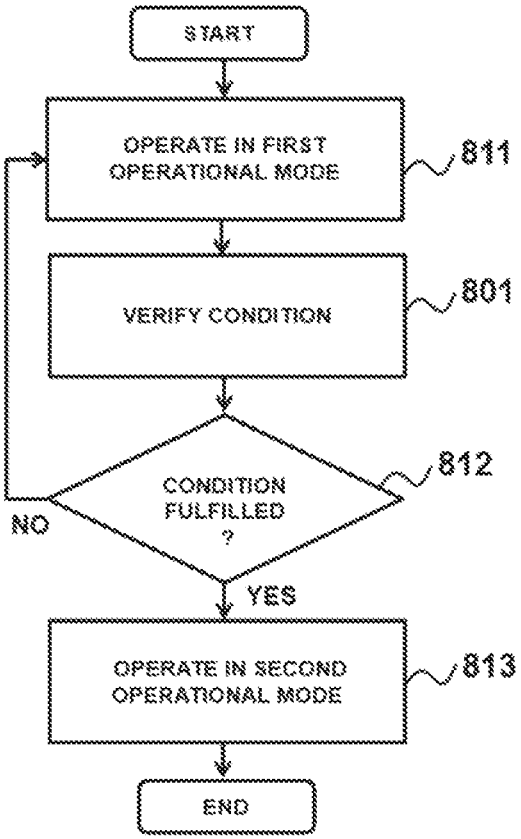

FIG. 8B illustrates another block flow diagram for an exemplary method of operating a hearing device to actuate a movement of a slidable member included in the hearing device. The method may be executed by controller 126 of hearing device 101, 611, 711. At 811, a first operational mode is executed in which a single movement of the slidable member is actuated at a certain time which may be determined depending on a parameter detected by a sensor and/or a command executed by the user. The single movement can comprise a forth movement or a back movement of the slidable member between different positions to adjust an effective size of a venting channel provided in housing 114 of hearing device of 101, 611, 711. During the first operational mode, operation 801 of verifying the condition is performed. At 812, it is determined whether the condition is fulfilled. When the condition is not fulfilled, for instance when the housing is still at least partially inserted into the ear canal, the first operational mode is continued to be executed at 811. When the condition is fulfilled, for instance when the housing is removed from the ear canal and/or the hearing device is mounted to a stationary device and/or the charging status of the battery exceeds a threshold, a second operational mode is executed at 813. In the second operational mode, a repetitive movement of the slidable member is actuated. Moreover, in the second operational mode, the actuator may be controlled to provide an actuation force for the forth movement and for the back movement of the slidable member with a larger magnitude as compared to the first operational mode. In this way, a cleaning functionality of the hearing device may be provided in the second operational mode.

While the principles of the disclosure have been described above in connection with specific devices, systems, and methods, it is to be clearly understood that this description is made only by way of example and not as limitation on the scope of the invention. The above described embodiments are intended to illustrate the principles of the invention, but not to limit the scope of the invention. Various other embodiments and modifications to those embodiments may be made by those skilled in the art without departing from the scope of the present invention that is solely defined by the claims. In the claims, the word "comprising" does not exclude other elements or steps, and the indefinite article "a" or "an" does not exclude a plurality. A single processor or controller or other unit may fulfil the functions of several items recited in the claims. The mere fact that certain measures are recited in mutually different dependent claims does not indicate that a combination of these measures cannot be used to advantage. Any reference signs in the claims should not be construed as limiting the scope.

What is claimed is:

1. A hearing device comprising a housing configured to be at least partially inserted into an ear canal of a user, the housing having an opening leading to an interior space enclosed by the housing;

a slidable member moveable relative to the opening between different positions including a first position and a second position;

an actuator configured to actuate the movement of the slidable member forth from the first position to the second position, and back from the second position to the first position; and a controller configured to control the actuator;

characterized in that the controller is configured to control the actuator to actuate the slidable member to repetitively move forth and back between the first and second position at a predetermined repetition rate.

2. The hearing device of claim 1, characterized in that the controller is configured to gather information indicative of whether the housing is removed from the ear canal, and to control the actuator to actuate said repetitive movement of the slidable member when the housing is removed from the ear canal.

3. The hearing device of claim 1, characterized in that the controller is configured to gather information whether the hearing device is mounted to a stationary device configured to be operated at a fixed location remote from the user, and to control the actuator to actuate said repetitive movement of the slidable member when the hearing device is mounted to the stationary device.

4. The hearing device of claim 3, characterized in that the hearing device comprises a rechargeable battery, and the stationary device comprises a charging station for the rechargeable battery.

5. The hearing device of claim 1, characterized in that the hearing device comprises a rechargeable battery, and the controller is configured to gather information about a charging status of the battery and to control the actuator to actuate said repetitive movement of the slidable member depending on the charging status.

6. The hearing device of claim 1, characterized in that the opening leads to a venting channel configured to provide for a venting of sound waves between an inner region of the ear canal and an ambient environment outside the ear canal when the housing is at least partially inserted into the ear canal, wherein the slidable member is moveable relative to the venting channel such that an effective size of the venting channel can be adjusted by the movement of the slidable member forth or back between the first and second position.

7. The hearing device of claim 6, characterized in that the controller is configured to control the actuator to actuate, in a first operational mode, the movement of the slidable member forth or back between the first and second position to adjust the effective size of the venting channel, and, in a second operational mode, to actuate said repetitive movement of the slidable member.

8. The hearing device of claim 7, characterized in that the controller is configured to control the actuator to provide a first actuation force for actuating the movement of the slidable member forth from the first position to the second position, and a second actuation force for actuating the movement of the slidable member back from the second position to the first position with an increased magnitude during said second operational mode as compared to a magnitude of the first and/or second actuation force provided during said first operational mode.

9. The hearing device of claim 1, characterized in that a trajectory of the movement of the slidable member between the first position and the second position extends at least partially across the opening.

10. The hearing device of claim 1, characterized in that, during the movement of the slidable member between the first position and the second position, the slidable member is slidable along a surface exposed to the interior space.

11. The hearing device of claim 1, characterized in that the slidable member comprises a surface facing the opening, wherein the slidable member is moveable in a direction in which said surface faces the opening.

12. The hearing device of claim 1, characterized in that the slidable member is spaced from the opening in the first position and in the second position of the slidable member.

13. The hearing device of claim 1, characterized by a cerumen filter provided at the opening.

14. A hearing system comprising the hearing device of claim 1, and a stationary device configured to be operated at a fixed location remote from the user, wherein the hearing device can be mounted to the stationary device.

15. A method of operating a hearing device, the hearing device comprising:

a housing configured to be at least partially inserted into an ear canal of a user, the housing having an opening leading to an interior space enclosed by the housing;

a slidable member moveable relative to the opening between different positions including a first position and a second position; and an actuator configured to actuate the movement of the slidable member forth from the first position to the second position, and back from the second position to the first position;

characterized in that the method comprises controlling the actuator to actuate the slidable member to repetitively move forth and back between the first and second position at a predetermined repetition rate.

* * * * *